US007258556B1

(12) United States Patent
Boutros et al.

(10) Patent No.: US 7,258,556 B1
(45) Date of Patent: Aug. 21, 2007

(54) SPRING LOADED COVER FOR ELECTRICAL CONNECTOR

(75) Inventors: Kamal Boutros, Richmond Hill (CA); Angus Parekunnel, Mississauga (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/267,269

(22) Filed: Nov. 7, 2005

Related U.S. Application Data

(60) Provisional application No. 60/625,587, filed on Nov. 8, 2004.

(51) Int. Cl.
*H01R 13/44* (2006.01)

(52) U.S. Cl. ..... 439/142; 439/160; 439/357

(58) Field of Classification Search ..... 439/142, 439/160, 357–358
See application file for complete search history.

(56) References Cited

U.S. PATENT DOCUMENTS

| | | | | |
|---|---|---|---|---|
| 3,239,791 | A * | 3/1966 | Fyrk | 439/144 |
| 3,284,753 | A * | 11/1966 | Goldbaum | 439/142 |
| 4,205,890 | A * | 6/1980 | Bryant | 439/142 |
| 5,256,072 | A * | 10/1993 | Hatagishi | 439/79 |
| 6,638,083 | B2 * | 10/2003 | Rhude | 439/142 |
| 6,827,594 | B1 * | 12/2004 | Davis et al. | 439/157 |
| 6,851,958 | B1 * | 2/2005 | Rowland et al. | 439/142 |

* cited by examiner

*Primary Examiner*—Truc Nguyen
(74) *Attorney, Agent, or Firm*—Blank Rome LLP

(57) ABSTRACT

An electrical connector that includes a connector element having a housing with an open end and a cover pivotally coupled to the housing and movable between a first position in which the cover closes the open end of the housing and a second position in which the cover is spaced from the open end. The cover includes a coupling member adapted to engage another connector element. A biasing member biasing the cover member toward the first position.

15 Claims, 4 Drawing Sheets

SPRING LOADED COVER FOR ELECTRICAL CONNECTOR

RELATED APPLICATION

This application claims the benefit of U.S. Provisional Patent Application Ser. No. 60/625,587, filed Nov. 8, 2004, the subject matter of which is incorporated by reference in its entirety.

FIELD OF THE INVENTION

The present invention relates to an electrical connector. More specifically, the electrical connector includes a spring loaded cover for protecting the connector from dust and dirt and for securing the connector elements of the connector, e.g. plug and receptacle, together.

BACKGROUND OF THE INVENTION

Conventional electrical connectors include two mating parts, such as a plug and receptacle with corresponding male and female contacts. Typically, a latching mechanism is provided for securing the mating parts of the electrical connector together. However, conventional latching mechanisms are often susceptible to loosening.

Additionally, when the mating parts of the electrical connector are separated or disconnected, the mating parts, particularly the inner area of the receptacle part, are exposed to dust and dirt.

SUMMARY OF THE INVENTION

Accordingly, an object of the present invention is to provide a spring loaded cover for an electrical connector that protects the connector from dust and dirt.

Another object of the present invention is to provide a spring loaded cover for an electrical connector that securely latches the connector elements of the connector together.

The foregoing objects are basically attained by an electrical connector that includes a connector element having a housing with an open end and a cover pivotally coupled to the housing and movable between a first position in which the cover closes the open end of the housing and a second position in which the cover is spaced from the open end. The cover includes a coupling member adapted to engage another connector element. A biasing member biasing the cover member toward the first position.

The foregoing objects are also attained by an electrical connector including first and second complementary connector elements, and a cover pivotally coupled to a housing of the first connector element and movable between a first position in which the cover closes an open end of the housing and a second position in which the cover is spaced from the open end. The cover including a first coupling member engageable with a second coupling member disposed on the second connector element. A biasing member biases the cover toward the second position to engage the first and second coupling members, thereby latching the first and second complementary connector elements until the cover is rotated to the second position against the bias of the biasing member.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
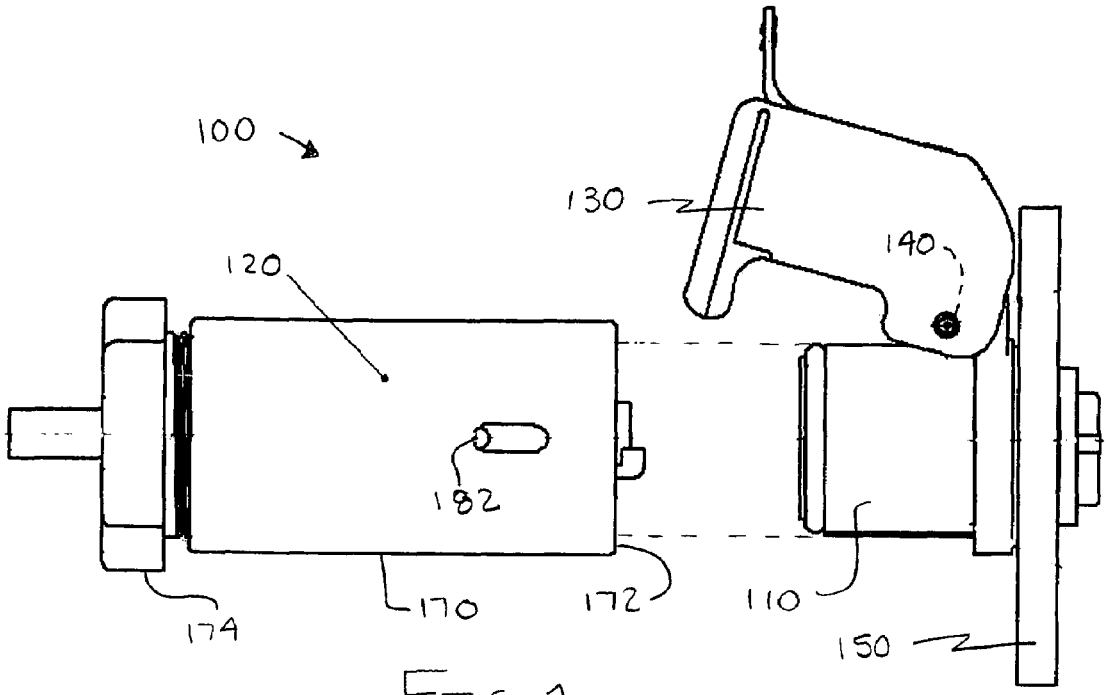
FIG. 1 is an exploded perspective view of an electrical connector according to an embodiment of the present invention, showing first and second connector elements of the connector before assembly.

Referring to FIGS. 1-7, an electrical connector 100 in accordance with the present invention generally includes mating first and second connector elements 110 and 120 and a cover 130 pivotally connected thereto and is biased a biasing member 140. Connector elements 110 and 120 can be any type of mating male and female connector parts, such as a receptacle and plug with conventional mating socket and pin. The electrical connector 100 is preferably used in an industrial application. For example, the first connector element 110 can be mounted in an equipment panel 150 and the second connector element 120 can be connected to a computer, monitoring or testing device (not shown). The biased cover 130 both insures the connector elements 110 and 120 remain latched when they are connected and protects the first connector element 110 against dust and dirt when the two elements 110 and 120 are disconnected.

Figure 3:
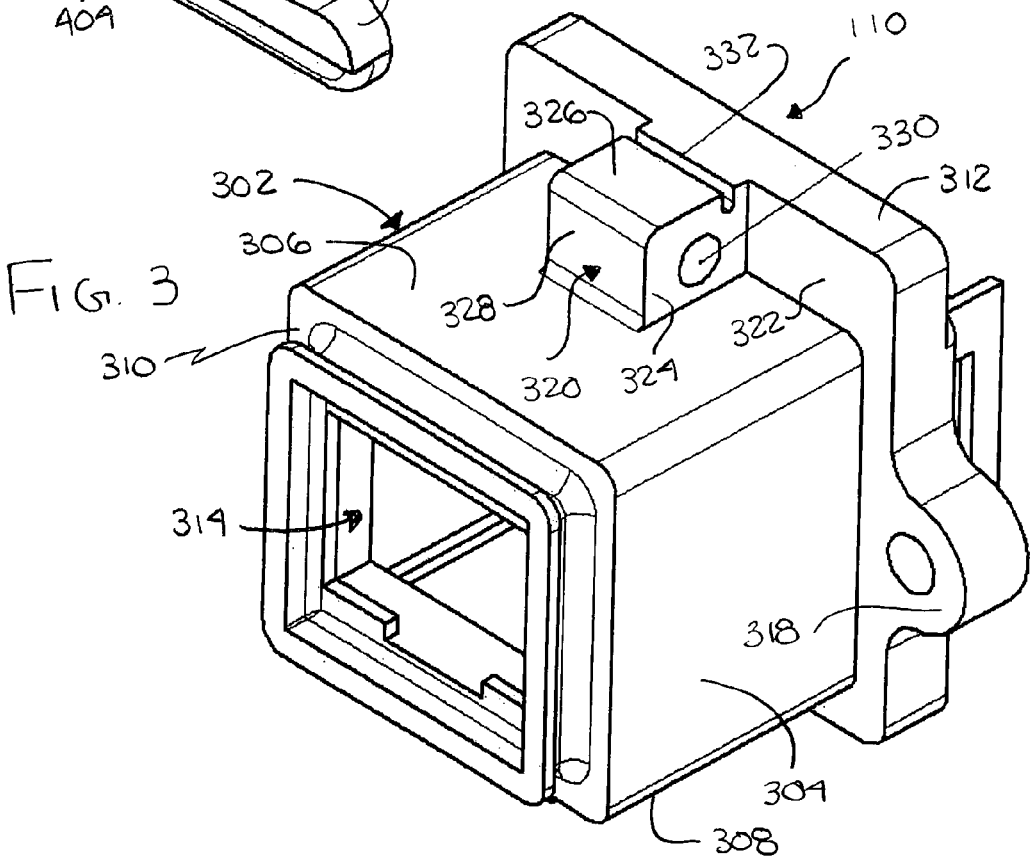
FIG. 3 is a front perspective view of a housing of the connector element illustrated in FIG. 1.

As seen in FIG. 3, the first connector element 110 includes a housing or shell 302 with opposite sidewalls 304, and top and bottom walls 306 and 308 extending between the sidewalls 304. A connector interface 310 is disposed at one end of the housing 302 for engaging the second connector element 120. An enlarged rear mounting wall 312 is disposed at the other end opposite the connector interface 310. The connector interface 310 includes an opening 314 providing access to the inside of the housing 302 and a sealing gasket 712 (FIG. 7) disposed around the periphery of the opening 314. The rear mounting wall 312 including ears 318 for mounting the housing 302 to the panel 150. Although the housing 302 is shown as having a substantially rectangular cross-sectional shape, the housing 302 can have any shape, such as a tubular shape.

An axle support member 320 is generally centrally located between the rear mounting wall 312 and the top wall 306 of the housing 302. The axle support member 320 extends from a face 322 of the rear mounting wall 312 and includes sides 324, and top and end portions 326 and 328 extending between the sides 324. Extending through the axle support member 320 is a center pivot hole 330. The center pivot hole 330 extends between sides 324 and receives an axle 510. A transverse slot 332 is exposed on the top portion 326 of the axle support member 320 and extends between the sides 324. The transverse slot 332 receives a portion of the biasing member 140.

Figure 4:
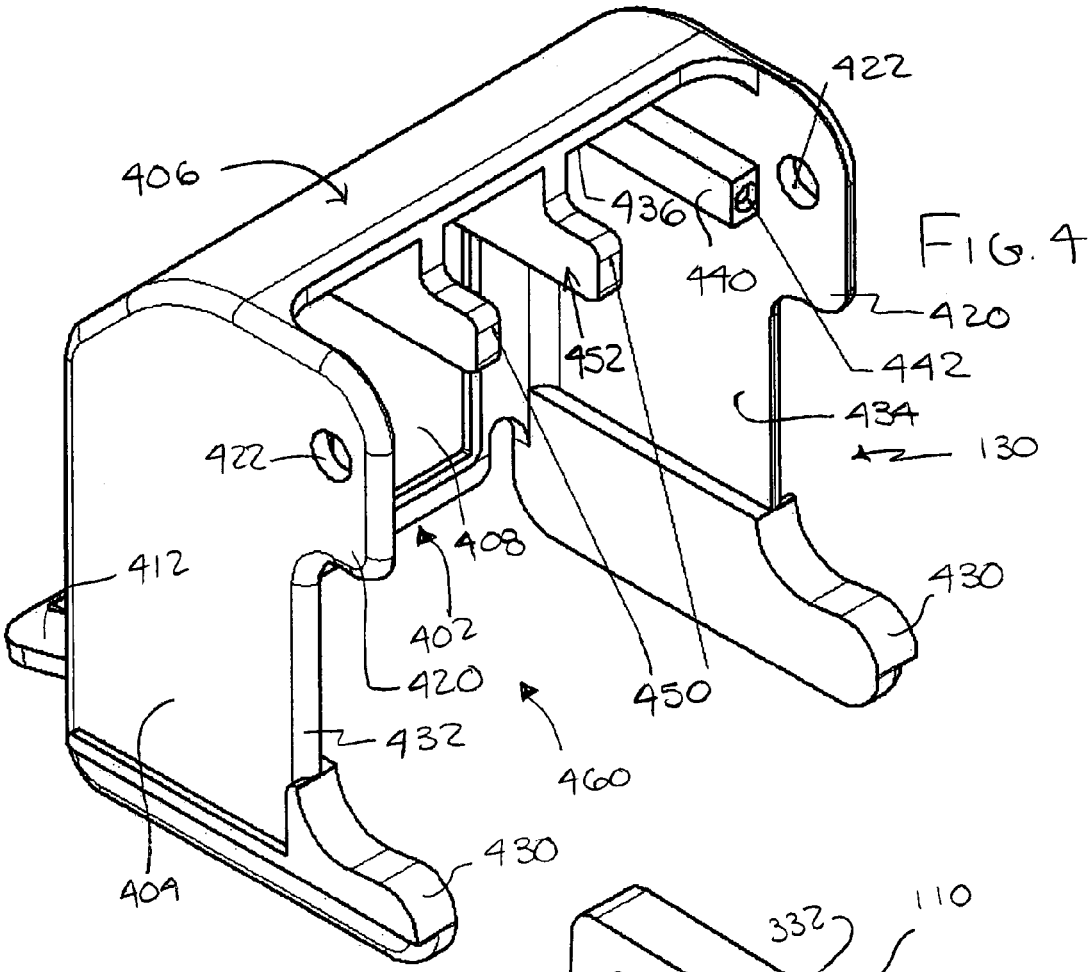
FIG. 4 is a rear perspective view of the cover of the electrical connector illustrated in FIG. 1.

As seen in FIG. 4, the cover 130 includes a main wall 402, sidewalls 404, and a truncated top wall 406 extending between the sidewalls 404. The main wall 402 includes an inner surface 408 with a sealing gasket 710 (FIG. 7) that corresponds to the sealing gasket 712 (FIG. 7) located on the connector interface 310 of the housing 302. A handle 412 extends outwardly from the main wall 402 to facilitate rotation of the cover 130. Pivot extensions 420 extend from each sidewall 404 near the top wall 306. Each pivot extension 420 includes a pivot hole 422 for receiving the axle 510.

Remote from the pivot extensions 420 are coupling members 430 extending from the sidewalls 404. A cut-out section 432 is defined between the pivot extensions 420 and the coupling members 430 of each sidewall 404. The coupling members 430 are preferably catches that engage a corresponding coupling member of the second connector element 120, as seen in FIG. 2.

Figure 6:
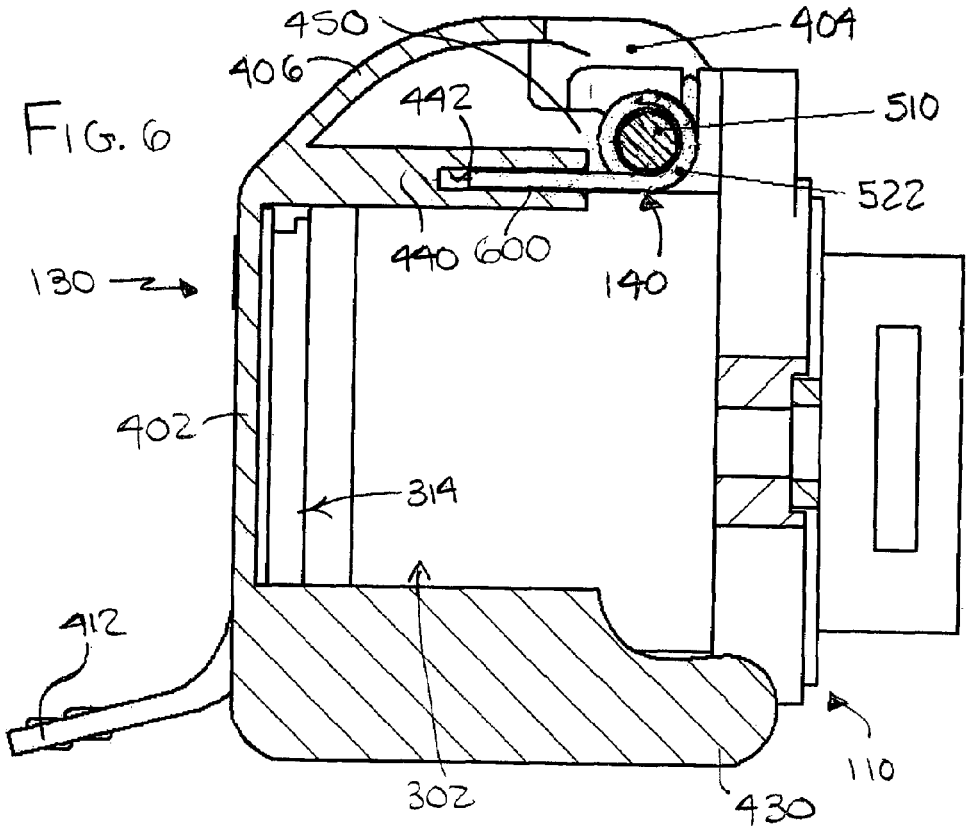
FIG. 6 is a side elevational view of the connector element in section taken along line 6-6 of FIG. 5.

Extending from the inner surfaces 434 of the sidewalls 404 and the inner surface 408 of the main wall 402 are a first set of ribs 440. Each rib 440 has a bore 442 extending partially through the rib 440 for receiving a portion of the biasing member 140, as seen in FIGS. 4 and 6. A second set of ribs 450 extend from the inner surface 436 of the top wall 406 and are generally centrally located between the sidewalls 404. The second set of ribs 450 define a receiving area 452 therebetween for receiving the end portion 328 of the axle support member 320 of the housing 302.

The biasing member 140 is preferably a torsional spring that includes first and second spring sections 520 and 522 and a flat section 524 disposed therebetween. The first and second spring sections 520 and 522 are axially aligned with one another, and the flat section 524 is axially off-set from the spring sections 520 and 522, as seen in FIG. 6. Each spring section 520 and 522 includes a spring arm 600 adapted to engage the bores 442 of the ribs 440 of the cover 130. Although the biasing member 140 is preferably a torsional spring, any type of known spring member can be used, such as a flat spring, compression spring, or the like.

Figure 2:
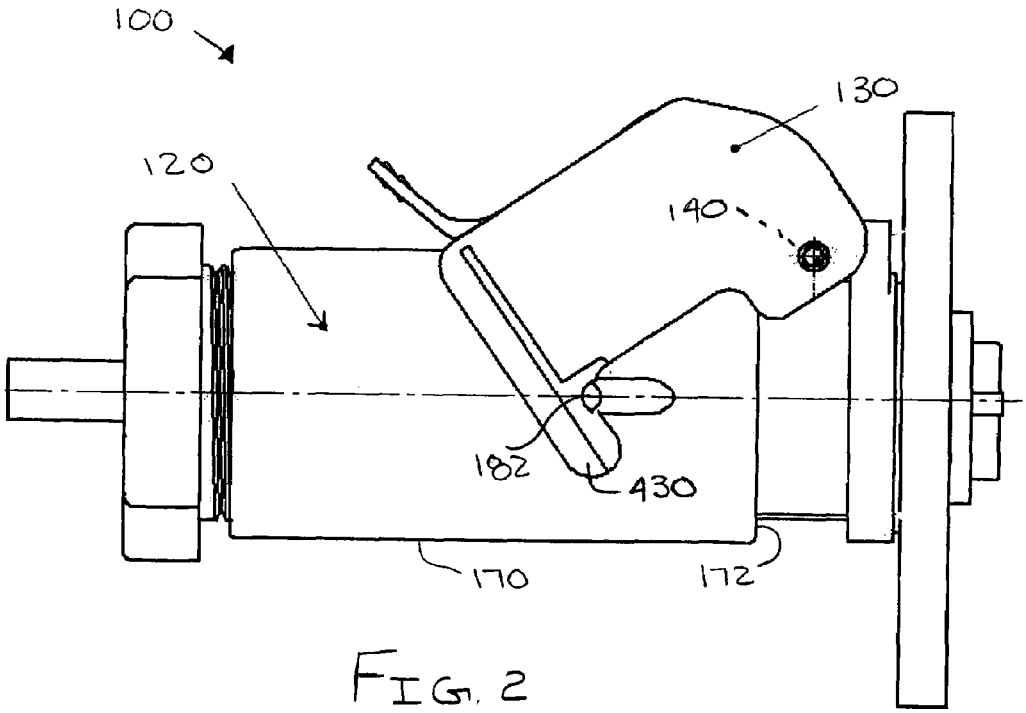
FIG. 2 is a side elevational view of the electrical connector illustrated in FIG. 1, showing the connector elements assembled, and showing a spring loaded cover of one of the connector elements engaged with the other connector element.

As seen in FIG. 2, second connector element 120 includes a body 170 having a connector mating end 172 and an opposite cable end 174. The shape of body 170 preferably corresponds to the shape of the housing 302. Coupling members 182 extend from opposite sides of the body 170 for catching the cover 130. Coupling members 182 are preferably pins.

To assemble the first connector element 110, the cover 130 and the biasing member 140, the top and bottom walls 306 and 308, and the sidewalls 304 of the housing 302 are received in the cavity 460 defined by the main wall 402, the sidewalls 404 and the truncated top wall 406 of the cover 130. The axle support member 320 of the housing 302 is received in the receiving area 452 between the ribs 450 of the cover 130 so that the ribs 452 rest against the sides 324 of the axle support member 320, as best seen in FIGS. 3 and 6. The ribs 452 prevent axial displacement of the housing 302 with respect to the cover 130.

Figure 5:
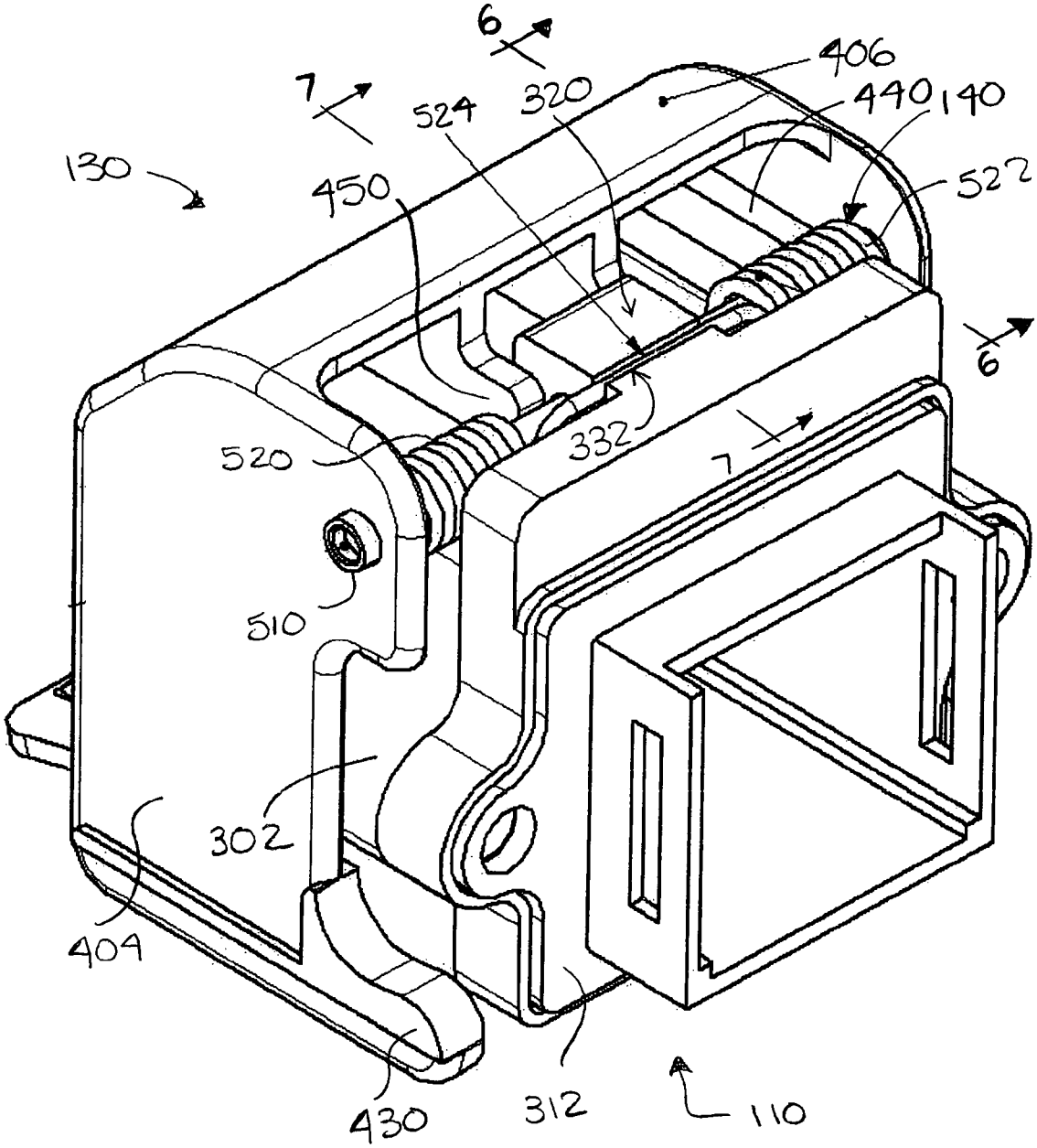
FIG. 5 is a rear perspective view of a connector element of the electrical connector illustrated in FIG. 1, showing the pivotal connection between the connector element and the cover thereof.
Figure 7:
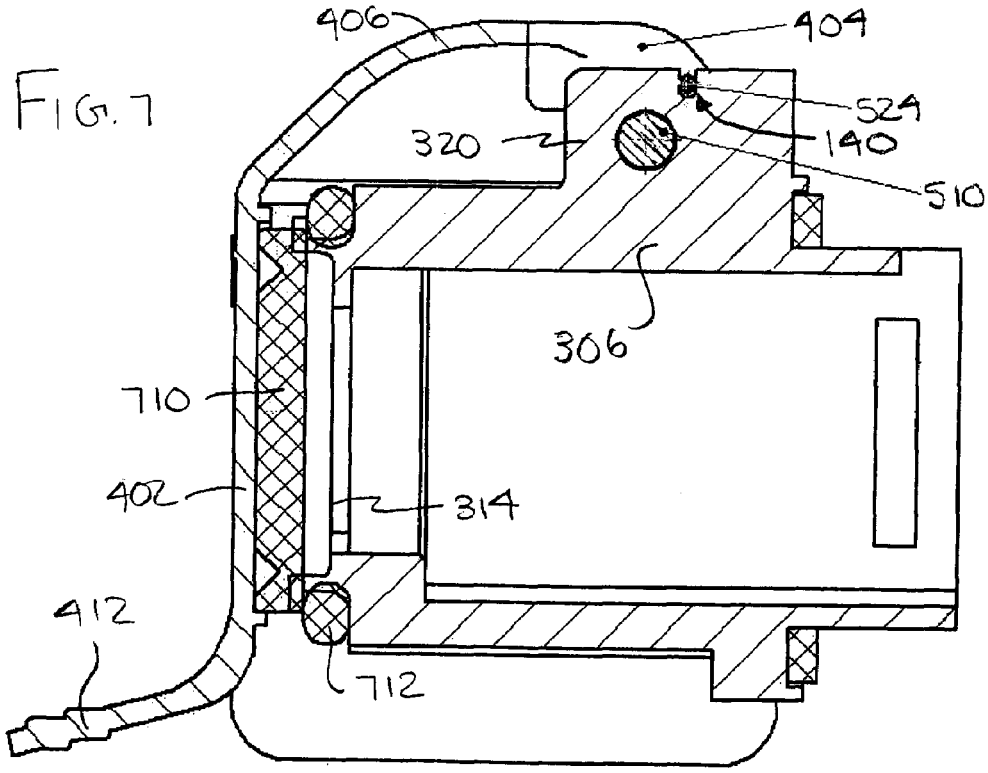
FIG. 7 is a side elevational view of the connector element in section taken along line 7-7 of FIG. 5.

As seen in FIG. 5, the biasing member 140 is located between the cover 130 and the housing 302 with the flat portion 524 of the biasing member 140 being disposed in the slot 332 of the axle support member 320. The first and second sections 520 and 522 of the biasing member 140 are located on either side of the axle support member 320. Pivot holes 422 of the sidewalls 304 of the cover 130 are aligned with the pivot hole 330 of the axle support member 320. Axle 510 extends through the pivot holes 422 of the cover sidewalls 304, through the pivot hole 330 of the axle support member 320, and through the first and second sections 520 and 522 of the biasing member 140. Because the spring arms 600 of biasing member 140 are disposed in the bores 442 of the ribs 440 of the cover 130, the cover 130 is biased toward a close position. In the closed position, the main wall 402 of the cover 130 engages the connector interface 310 of the housing 302, thereby closing the end opening 314 of the housing 302, as seen in FIGS. 6 and 7. The sealing gaskets 712 and 710 engage one another in the closed position, as seen in FIG. 7, to protect the inside of the housing 302. When the first and second connector elements 110 and 120 are not connected, the cover 130 seals the opening 314 of the first connector element 110 to prevent dirt and dust from entering inside of the housing 302

In operation, the cover 130 rotates between the closed position (FIG. 7) and open positions (FIGS. 1 and 2) using the handle 412 to rotate the cover 130. To connect the second connector element 120 to the first connector element 110, the cover 130 can be rotated upwardly by its handle 412 against the biasing of member 140 and its spring arms 600, as seen in FIG. 1. The connector mating end 172 of the second connector element 120 is then inserted over the housing 302 of the first connector element 110, as seen in FIG. 2. Cover 130 then rotates downwardly until catches 430 of cover 130 engage pins 182 of the second connector element 120. The biasing force of member 140 on cover 130 and the engagement of cover catches 430 with pins 182 of the second connector element 120 together latch the connector elements 110 and 120. The bias of the member 140 maintains the engagement of the catches 430 with the pins 182 until the handle 412 is rotated upwardly against the bias of the member 140 to disconnect the elements 110 and 120. When the connector elements 110 and 120 are disconnected, the biasing member 140 will drop back to the closed position due to the bias of the member 140, thereby protecting the connector element 110 when not in use.

While a particular embodiment has been chosen to illustrate the invention, it will be understood by those skilled in the art that various changes and modification can be made therein without departing from the scope of the invention as defined in the appended claims. For example, although pins 182 and catches 430 are preferably used to latch the connector elements 110 and 120, any type of known latching engagement can be used, such as a snapping engagement, hook and loop engagement, and the like. Only a single pin 182 and a catch 430 are needed to latch the elements 110 and 120. In addition, pins 182 can be located on cover 130 and catches 430 located on the second connector element 120. Also, cover 130 can be pivotally mounted to either connector element 110 and 120 as long as spring 140 biases the cover 130 in the closed position to protect the connector element.

What is claimed is:

1. An electrical connector, comprising:

a connector element having a housing with an open end;

a cover pivotally coupled to said housing and movable between a first position in which said cover closes said open end of said housing and a second position in which said cover is spaced from said open end, said cover including first and second ribs that engage a portion of said housing for preventing axial displacement of said cover with respect to said housing, and said cover including a main wall and at least one sidewall extending therefrom, said main wall closing said open end when said cover is in said first position with said sidewall extending along a side of said housing, and said sidewall having a coupling member adapted to engage another connector element; and a biasing member biasing said cover member toward said first position.

2. An electrical connector according to claim 1, wherein said biasing member is a torsional spring disposed between said housing and said cover.

3. An electrical connector according to claim 1, wherein said coupling member includes a plurality of catches extending from said cover member.

4. An electrical connector according to claim 1, wherein said main wall includes a gasket engageable with a gasket at said open end for sealing said connector element when said cover is in said first position.

5. An electrical connector according to claim 1, wherein said coupling member is a catch extending from said at least one sidewall.

6. An electrical connector according to claim 2, wherein arms of said torsional spring engage holes disposed in said cover.

7. An electrical connector according to claim 2, wherein a portion of said torsional spring engages a slot in said housing.

8. An electrical connector according to claim 1, further comprising a handle extending from said cover for moving said cover between said first and second positions.

9. An electrical connector according to claim 5, wherein said catch is located remote from the pivot point between said cover and said housing.

10. An electrical connector, comprising:

first and second complementary connector elements;

a cover pivotally coupled to a housing of said first connector element and movable between a first position in which said cover closes an open end of said housing and a second position in which said cover is spaced from said open end, said cover including first and second ribs that engage a portion of said housing for preventing axial displacement of said cover with respect to said housing, and said cover including a main wall and at least one sidewall extending therefrom, said main wall closing said open end when said cover is in said first position with said sidewall extending along a side of said housing, and said sidewall having a first coupling member engageable with a second coupling member disposed on said second connector element; and a biasing member biasing said cover toward said second position to engage said first and second coupling members, thereby latching said first and second complementary connector elements until said cover is rotated to said second position against the bias of said biasing member.

11. An electrical connector according to claim 10, wherein said biasing member is a torsional spring disposed between said housing and said cover.

12. An electrical connector according to claim 10, wherein said first coupling member is a catch; and said second coupling member is a pin extending from a housing of said second connector element, said catch applying pressure to said pin by said biasing member.

13. An electrical connector according to claim 10, wherein said first connector element is a receptacle, and said second connector element is a plug.

14. An electrical connector according to claim 10, wherein said first coupling member includes a plurality of catches extending from said cover member; and said second coupling member includes a plurality of pins corresponding to said plurality of catches.

15. An electrical connector, comprising:

first and second complementary connector elements;

a cover pivotally coupled to a housing of said first connector element and movable between a first position in which said cover closes an open end of said housing and a second position in which said cover is spaced from said open end, said cover including first and second ribs that engage a portion of said housing for preventing axial displacement of said cover with respect to said housing, and said cover including a main wall for closing said open end and a first coupling member engageable with a second coupling member disposed on said second connector element;

a biasing member biasing said cover toward said second position to engage said first and second coupling members, thereby latching said first and second complementary connector elements until said cover is rotated to said second position against the bias of said biasing member; and a handle extending from said cover at an angle and away from said main wall of said cover, whereby actuation of said handle moves said cover between said first and second positions.

* * * * *